US007546803B2

(12) United States Patent
Konaka et al.

(10) Patent No.: US 7,546,803 B2
(45) Date of Patent: Jun. 16, 2009

(54) LETTERPRESS PRINTING MACHINE

(75) Inventors: Yukio Konaka, Tokyo (JP); Tomoaki Fukuhara, Tokyo (JP); Hiroshi Matsuzawa, Tokyo (JP)

(73) Assignee: Toppan Printing Co., Ltd. (JP)

( * ) Notice: Subject to any disclaimer, the term of this patent is extended or adjusted under 35 U.S.C. 154(b) by 225 days.

(21) Appl. No.: 11/604,074

(22) Filed: Nov. 22, 2006

(65) Prior Publication Data

US 2007/0175349 A1 Aug. 2, 2007

(30) Foreign Application Priority Data

Jan. 30, 2006 (JP) ..... 2006-020478
Jan. 31, 2006 (JP) ..... 2006-023335
Apr. 26, 2006 (JP) ..... 2006-121496

(51) Int. Cl.
*B41F 35/00* (2006.01)

(52) U.S. Cl. ..... 101/424; 101/425

(58) Field of Classification Search ..... 101/424, 101/425

See application file for complete search history.

(56) References Cited

U.S. PATENT DOCUMENTS 3,656,431 A * 4/1972 Giori ..... 101/425
3,701,316 A * 10/1972 Sylvester et al. ..... 101/148
3,913,797 A * 10/1975 Brym ..... 222/253
3,980,018 A * 9/1976 Ichikawa ..... 101/170
4,393,778 A * 7/1983 Kaneko ..... 101/425
6,420,200 B1 7/2002 Yamazaki et al.
6,472,121 B2 * 10/2002 Murphy et al. ..... 430/273.1
6,582,504 B1 6/2003 Fujita
7,137,697 B2 * 11/2006 Lehmann ..... 347/103
2004/0021413 A1 2/2004 Ito et al.
2004/0050277 A1 * 3/2004 Stanka ..... 101/425
2004/0163561 A1 * 8/2004 Yokoyama ..... 101/425

FOREIGN PATENT DOCUMENTS

| | | |
|---|---|---|
| JP | 05-078655 | 3/1993 |
| JP | 08-244194 | 9/1996 |
| JP | 10-012377 | 1/1998 |
| JP | 10-077467 | 3/1998 |
| JP | 11-024604 | 1/1999 |
| JP | 2000-511835 | 9/2000 |
| JP | 2001-076873 | 3/2001 |
| JP | 2001-093668 | 4/2001 |
| JP | 2001-155858 | 6/2001 |
| JP | 2001-155861 | 6/2001 |
| JP | 2001-185352 | 6/2001 |
| JP | 2001-185360 | 7/2001 |
| JP | 2001179928 A * | 7/2001 |

(Continued)

*Primary Examiner*—Anthony H. Nguyen
(74) *Attorney, Agent, or Firm*—Squire, Sanders & Dempsey L.L.P.

(57) ABSTRACT

A letterpress printing machine is disclosed including a rotary printing cylinder in which a relief printing plate is installed, a substrate surface plate on which a substrate is placed, an ink supply device supplying ink on the relief printing plate, a relief printing plate washing equipment washing the surface of the relief printing plate, and a wiper for a plate. The relief printing plate washing equipment can include a washing liquid supplying unit, an air blasting unit jetting pressurized gas to the relief printing plate, a suction unit sucking the washing liquid scattered by air blasting unit, and a washing liquid recovery unit.

7 Claims, 10 Drawing Sheets

FOREIGN PATENT DOCUMENTS

| | | |
|---|---|---|
| JP | 2001-291587 | 10/2001 |
| JP | 2002-100472 | 4/2002 |
| JP | 2002-305077 | 10/2002 |
| JP | 2002-313561 | 10/2002 |
| JP | 2003-059654 | 2/2003 |
| JP | 2003-059656 | 2/2003 |
| JP | 2003-243163 | 8/2003 |
| JP | 2003-282244 | 10/2003 |
| JP | 2004-055333 | 2/2004 |
| JP | 2004-063359 | 2/2004 |
| JP | 2004-355913 | 12/2004 |
| JP | 2005-059348 | 3/2005 |
| WO | WO 99/10862 | 4/1999 |

* cited by examiner

LETTERPRESS PRINTING MACHINE

CROSS REFERENCE

This application claims priority to Japanese application number 2006-20478, filed on Jan. 30, 2006, priority to Japanese application number 2006-23335, filed on Jan. 31, 2006, and priority to Japanese application number 2006-121496, filed on Apr. 26, 2006, which are incorporated herein by reference.

BACKGROUND OF THE INVENTION

1. Field of the Invention

The present invention is related to a letterpress printing machine. Especially the present invention suits to form a luminescent layer of a macromolecular system organic electroluminescent display unit by printing. In addition, in this case, the ink having a macromolecular system organic material dissolved in a solvent is printed on a substrate.

In addition, the present invention is related to flexographic printing method. In addition, the present invention is related to a letterpress printing machine with the use of a plastic plate. According to the current invention, minute pattern can be formed on a substrate uniformly. According to the current invention, minute pattern of high position accuracy can be formed on a substrate. According to the current invention, minute pattern can be formed on a substrate continuously and stably. More particularly, the present invention is related to an improvement of letterpress printing machine suitable for formation of the following high minute pattern: Pattern of color filter for liquid crystal displays (LCD); a luminescent layer and a charge transport layer of an organic electroluminescent element; an electrode pattern of organic thin film transistor (TFT) substrate; and a sealed pattern in electromagnetic wave shielding.

2. Description of the Related Art

In late years, as a display device in portable telephone, PDA (a personal digital assistant), a mobile PC and a navigation system adapting for car, an organic electroluminescent element comprising the following characteristic attracts attention:

1. Thin;
2. Low power consumption; and
3. A bright display.

For example, as for this organic electroluminescent element, anode (transparent conductive film, ITO film) and a luminescent layer containing an organic luminous body and a cathode (metal electrode) are formed on a transparent substrate.

As method to form minute pattern having the following characteristic on a substrate continuously and stably, a photolithography method is used mainly now.

1. Intra-plane uniformity; and
2. High accuracy of position.

In this photo-lithography method, a manufacturing cost is high for reasons of the follows.

1. Process is complicated; and
2. Manufacturing facility is expensive.

In addition, offset printing can be used instead of photolithography method. Offset printing is explained below.

A blanket comprising silicone system rubber is used. Ink transfers from a blanket to a substrate such as a glass.

Offset printing has the following defect.

1. Ink at non-printing area is removed by a press plate.
2. And this ink is disposed.

Therefore, a flexo printing method which is superior in ink mileage attracts attention instead of offset printing.

A luminescent layer of an organic electroluminescent element is usually formed by vacuum deposition of a low molecular organic luminous body. For this case, there is a limit for upsizing of an element from the viewpoint of evaporation apparatus.

Thus the following attempt is proposed.

Ink is made by dissolving a macromolecular organic luminous body in a solvent. Using this ink, a luminescent layer is formed by a well-known printing method. (e.g. Patent Reference 1 cited below).

Such a printing method can be superior to mass production characteristics. In addition, a manufacturing cost can be lowered. Offset printing or gravure printing are nominated for such a printing method.

On the other hand, flexographic printing is the printing method how flexible relief printing plate comprising rubber or resins, an anilox roll and ink are used. Conventionally, flexographic printing has been widely used in manufacturing simple printed matters such as wrapping papers. This flexographic printing is especially suitable for formation of a thin and stable print layer of about 0.01-0.2 μm in thickness. In flexographic printing, a relief printing plate part where printing pressure is applied has flexibility. In addition, in flexographic printing, printing with extremely low printing pressure called a kiss touch is performed.

Therefore, flexographic printing is suitable for printing to the following substrate.

1. A glass substrate; and
2. The substrate on which the transparent electrodes having a characteristic capable of being damaged by high pressure are formed.

Therefore, flexographic printing is a printing process especially suitable for formation of a luminescent layer of an organic electroluminescent element.

Conventional flexographic printer is explained in FIG. 4. Flexographic printer has the following member shown in FIG. 4: Anilox roll (anilox board) 101 which supplies ink to flexographic plate (relief printing plate) 105; rotary printing cylinder 102 on which flexographic plate (relief printing plate) for pattern formation 105 is loaded through cushion 104 under a plate; substrate surface plate 103 on which substrate 111 is put; and doctor blade 112 scraping off unnecessary ink on anilox roll 101.

In addition, thickness of flexographic plate (relief printing plate) 105 is measured beforehand. And distance between printing cylinder 102 and substrate surface plate 103 at the time of printing are decided. And while keeping the decided distance uniformly, ink transfers.

The relief printing plate used in flexographic printing comprises materials such as a resin or rubber which can be transformed by pressure. Therefore, in flexographic printing, high printing pressure is not required. In addition, the relief printing plate does not comprise hard material such as a metal and a glass. Therefore, even if substrate is the material which is easy to be damaged (e.g. glass substrate), it can be printed.

In the case of printing, ink is supplied to an anilox roll from an ink feeding mechanism. Subsequently a constant amount of ink transfers to a relief printing plate because a relief printing plate held by printing cylinder touches an anilox roll. Finally ink transfers from a relief printing plate to a substrate. Printing is performed in this way.

According to such flexographic printing, precise pattern can be formed on a substrate such as a glass. In addition, by relief printing using a resin as a material of a printing plate, precise pattern can be also efficiently formed on a substrate such as a glass.

In addition, in printing, pressure between a printing plate and a substrate is important. For example, in a gravure printing, ink in concave portion transfers to substrate by applying very strong pressure. On the other hand, by relief printing and flexographic printing, ink on projection part transfers to a substrate.

Therefore, in relief printing and flexographic printing, high pressure required in a gravure printing is not necessary.

However, it is necessary for a printing plate to touch substrate surely. Thus thickness of a printing plate and a cushion between a printing plate and printing cylinder is usually considered beforehand. And distance between printing cylinder and a substrate surface plate is decided. While fixing distance is determined here, printing is performed.

Case of flexographic printing is explained below.

Pressure-sensitive film is put between a printing cylinder and a substrate surface plate before printing. And a variation of printing pressure within a printing face is observed when pressure is applied. Or change of nip width by pressure application is observed when the printing plate on which ink is applied touches a substrate surface plate at a fixed point. While confirming a variation of printing pressure and nip width in this way, distance between printing cylinder and a substrate surface plate is modified. Till printing pressure or nip width within a printing face falls within a predetermined range, confirmation and adjustment are repeated. In addition, in order to absorb an impact at the time of printing and a variation of printing pressure, material of cushioning characteristics can be placed on a substrate surface plate (e.g. Patent Reference 3, Patent Reference 4).

Patent Reference 1: Japanese Patent Laid-Open No. 2001-185352 Official Gazette

Patent Reference 2: JP-T 2000-511835 Official Gazette

Patent Reference 3: Japanese Patent Laid-Open No. 8-244194 Official Gazette

Patent Reference 4: JP-T 2003-502175 Official Gazette

Patent Reference 5: Japanese Patent Laid-Open No. 2005-59348 Official Gazette (Problem 1)

However, when, for example, an organic electroluminescent element is used in full color display unit purpose, it is necessary to apply inks independently about a luminescent layer of RGB. Therefore, minute pattern of a 150-200 ppi level is formed by flexographic printing. However, while a minute pattern printing is performed consecutively, dry ink accumulates in the surface and concave portions of a relief printing plate. And defectiveness such as fluctuation of printed line width and printed film thickness occurs. Especially, drying speed of macromolecular organic luminous ink is fast because the ink uses a volatile organic solvent. Therefore, deposit of ink is easy to occur. Therefore it is necessary to wash a relief printing plate in an interval of continuous printing.

On the other hand, cleaning of a relief printing plate should be performed without taking off a relief printing plate from a printing cylinder to keep positioning accuracy of a printed pattern.

As a prior art with respect to a printer loaded with the cleaning device which a relief printing plate are washed without a relief printing plate being taken off from a printing cylinder, a technique shown in e.g. Patent Reference 2 is known.

However, such a letterpress printing machine is maintained at the time of printing end. And washing method of such a letterpress printing machine is a method rubbing against a relief printing plate surface by a brush roll. Therefore, damage to a relief printing plate is big when a relief printing plate having minute pattern is washed regularly in an interval of presswork. Therefore, good printing cannot be performed. In addition, a relief printing plate is hard to get used to ink after having done cleaning of a relief printing plate. Therefore, enough inking is unable. Therefore, defectiveness such as reduction of line width or tackiness in printed matter occurs. Therefore, till good printing is possible, waste printing to about 1-5 substrates is necessary. On the occasion of mass production, there is a problem that a large quantity of substrates is used in periodical waste printing.

The present invention solves the conventional problems such as the above mentioned problem. The present invention provides a letterpress printing machine having the following characteristic: A relief printing plate can be washed while a relief printing plate is installed in a printing cylinder; and a relief printing plate can be washed without damaging a relief printing plate.

By enhancement of ink wettability to a relief printing plate, good printing is possible immediately after washing a relief printing plate.

In addition, using this relief printing plate, a luminescent layer of a macromolecular organic electroluminescent element can be formed.

(Problem 2)

Further, the following problem occurs when printing is performed while maintaining definitely the distance between printing cylinder 102 and substrate surface plate 103. As for cushion 104 put on printing cylinder 102, flexographic plate 105 and substrate, the thickness within a printing face is uneven. Therefore, printing pressure is uneven in a printing direction and a direction that is perpendicular to the printing direction. Therefore, when fine printing is performed, this unevenness affects print quality adversely. In addition, in flexographic printing, pressure-sensitive film is put on a substrate surface plate before printing. And unevenness of printing pressure within a printing face is observed when pressure between a substrate surface plate and a printing cylinder is applied.

In addition, printing plate which is applied ink touches a substrate surface plate in a fixed point. Then nip width can be observed.

While observing printing pressure or nip width, height of a substrate surface plate is adjusted.

Adjustment by above methods is repeated till printing pressure or nip width within a printing face is fixed.

In addition, after having adjusted height of a substrate surface plate, a cushion under a printing plate and a plate is changed. Then, due to individual difference of each member or printed pattern configuration, adjustment of nip is necessary each time. Therefore, operation load is enlarged.

On the other hand, thickness of a printing plate and a material of cushioning characteristics is several hundred μm—several mm respectively. Therefore unevenness of those thickness within a printing face is more than dozens of μm. Thickness and unevenness of thickness of substrate are similar to those of a printing plate and a material of cushioning characteristics.

During printing, distance determined beforehand between printing cylinder and substrate surface plate is kept. Therefore, printing pressure varies due to unevenness of thickness of printing plate or the like.

Change of printing pressure affects a printing result. Printed matter such as a book or a packaging material can permit change of such a printing pressure. However, when printing object is precise member which requires ink of thickness from several μm to several nm, change of such a printing pressure is a fatal problem. In addition, in consideration of unevenness of thickness of printing plates or the like, printing pressure can be adjusted so that an acceptable printing result can be obtained.

However, by a replacement of a printing plate and a cushion under a plate, complicated positioning is necessary each time. Therefore, there is a problem that operation load and loss of time are enlarged.

The present invention solves a conventional problem such as the above mentioned problem. It is an object of the present invention to provide the letterpress printing machine which enables a stable high quality printing.

In letterpress printing machine of the present invention, even if thickness of a printing plate, a cushion under a plate or the like is uneven, printing pressure within a printing face between a printing plate and substrate should be kept uniform at the time of printing.

(Problem 3)

Ink transposition to substrate consisting of a glass or the like must be performed in the lower part of printing cylinder. Therefore, ink application and ink transposition cannot be performed at the same time.

At first ink is applied to a flexographic plate from an anilox roll. Afterwards printing cylinder is moved to the upper part of a surface plate. And ink transposition to substrate is performed.

As a result, the time when ink is on flexographic plate is about 10-20 seconds. When ink in a flexographic plate dries in the meantime, ink does not transfer on substrate. Therefore, drying of ink is prevented by mixing high boiling point solvent with ink.

A method of only using ink by one printing is supplied using flat anilox board is proposed as other ink application method (e.g. Patent Reference 5). However, in the case of this method, ink application and ink transposition cannot be performed at the same time. Therefore, it is necessary to use the ink which includes high boiling point solvent. However, it is necessary for a printed matter such as a luminescent layer of an organic electroluminescent element formed using ink including high boiling point solvent to be dried at high temperature. In addition, residual of a solvent is easy to occur. Besides, as for the luminescent layer of an organic electroluminescent element, a characteristic deteriorates due to heating and a residual solvent. Therefore, luminous efficiency falls. In addition, characteristic life shortens.

In addition, time for ink applied on the surface of a flexographic plate transferring on substrate was about 15 seconds when printing was performed with a conventional printer using ink including a solvent. Both ink including methyl anisole and ink including xylene dried on a flexographic plate. Therefore, these inks did not transfer on a substrate.

Thus ink which methyl anisole included 15% cyclohexylbenzene (CHB, boiling point 239 degrees Celsius) was used. For this case, ink transferred on a substrate. By a vacuum dryer, this substrate was dried at 160 degrees Celsius. But the solvent has remained without completely volatilizing. An organic electroluminescent element was further made using this substrate. However, it was confirmed that luminous efficiency largely deteriorated. For example, the luminous efficiency when an organic electroluminescent element of an active method was driven at drive voltage 5V was about 6.8 cd/A.

The present invention solves a problem such as the above. The present invention provides a letterpress printing machine having the following characteristic: The machine can produce an inexpensive printed matter such as a macromolecule organic electroluminescent element of high luminous efficiency and long characteristic life.

SUMMARY OF THE INVENTION

A letterpress printing machine is disclosed including a rotary printing cylinder in which a relief printing plate is installed, a substrate surface plate on which a substrate is placed, an ink supply device supplying ink on the relief printing plate, a relief printing plate washing equipment washing the surface of the relief printing plate, and a wiper for a plate. The relief printing plate washing equipment can include a washing liquid supplying unit, an air blasting unit jetting pressurized gas to the relief printing plate, a suction unit sucking the washing liquid scattered by air blasting unit, and a washing liquid recovery unit.

Figure 1:
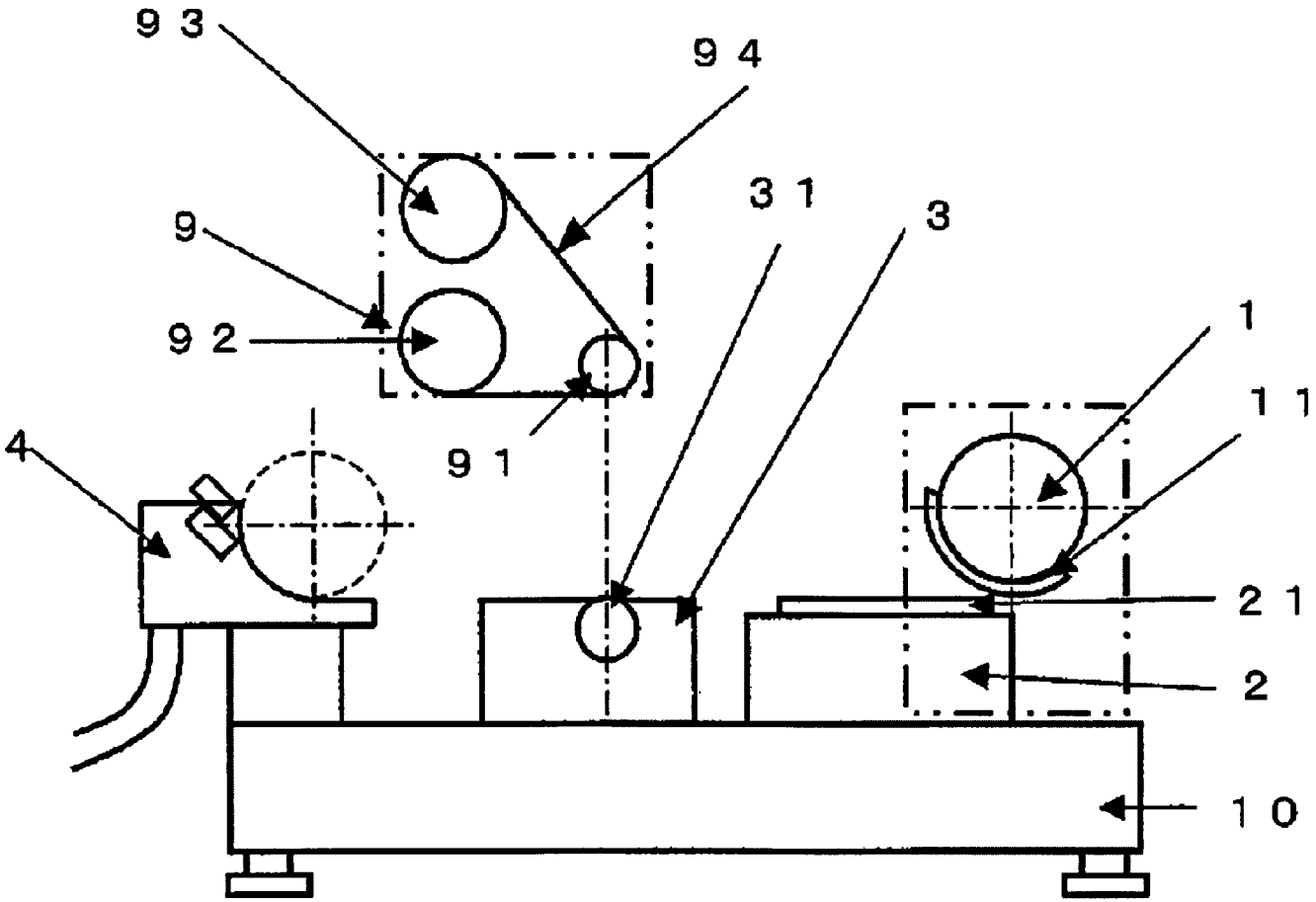
FIG. 1 is a schematic diagram which shows a letterpress printing machine in example 1.

In these drawings, 1 is a printing cylinder; 2 is a substrate surface plate; 3 is an ink supply device; 4 is a relief printing plate washing equipment; 5 is a washing liquid supplying unit; 6 is an air blasting unit; 7 is a suction unit; 8 is a cleaning liquid receiving pan; 9 is a wiper for plate; 10 is a base of a printer; 11 is a relief printing plate; 21 is a substrate; 31 is an anilox roll; 41 is a cover; 50 is ink; 51 is a washing liquid supply nozzle; 52 is a relief printing plate; **52*a* is a contact point of relief printing plate and substrate; 52*b* is a printing plate; 53 is a support base; 54 is a surface plate; 55 is a substrate; 56 is an ink supply means; 57 is an ink replenishing means; 61 is a gas injection nozzle; 71 is a suction hole; 91 is a wiping roll; 92 is a supply roll; 93 is a recovery roll; 94 is a wiping sheet; 101 is an anilox roll; 102 is a printing cylinder; 103 is a substrate surface plate; 104 is a cushion under a plate; 105 is a flexographic plate; 106 is an air cylinder; 107 is a balancer; 108 is a printing cylinder bearing; 109 is a vertical axis for printing cylinder; 110 is an up/down driving shaft; 111 is a substrate; 113 is a band-shaped pattern; 121 is a printing nip width (narrow); 122 is a printing nip width (wide); 123 is a printing cylinder drive motor; 511 is a printing cylinder; 561 is an anilox roll; 562 is an ink pot; 562***a* is an ink storage; 562*b* is an opening; 571 is an ink tank; 572 is an ink supplement pump; 573 is an ink supplement pipe; F is rotation direction.

DESCRIPTION OF THE PREFERRED EMBODIMENTS

Embodiment 1

The present invention is a letterpress printing machine comprising a rotary printing cylinder having a relief printing plate, a substrate surface plate on which a substrate is placed and the ink supply device which applies ink to a relief printing plate. Especially the present invention is applied to a flexographic printer.

In addition, for an embodiment of a printer, the following embodiments can be adopted: The embodiment that a rotary printing cylinder moves over a substrate surface plate; and the embodiment that a substrate surface plate moves under a printing cylinder.

In addition, for ink supply device, the following embodiments can be adopted: Plane anilox board comprises a doctoring mechanism; an anilox roll; and a capillary coater.

In addition, an installation configuration of a relief printing plate washing equipment changes depending on a mechanism of a letterpress printing machine.

A relief printing plate washing equipment of a letterpress printing machine which a printing cylinder moves is explained below. A relief printing plate washing equipment is installed in parallel with a substrate surface plate. A printing cylinder moves to a position where a printing cylinder faces a relief printing plate washing equipment.

A relief printing plate washing equipment of a letterpress printing machine which a printing cylinder position is fixed is explained below. A relief printing plate washing equipment usually evacuates. Only at the time of washing a relief printing plate, a relief printing plate washing equipment moves to a position where a relief printing plate washing equipment faces a printing cylinder.

However, an installation configuration of a relief printing plate washing equipment is not limited to the above. The apparatus that a rigid unit and a mobile unit coexist is possible.

In addition, a washing liquid supplying unit comprising a relief printing plate washing equipment is explained below. Washing liquid comprising a mixture of water and a washing agent or an organic solvent is flowed on the surface of a relief printing plate placed on a printing cylinder from a nozzle. A nozzle of the following embodiments can be used: Spray nozzles are arranged at equal intervals and parallel to one another along width direction of a printing cylinder; a spray nozzle moves along width direction of a printing cylinder. When influence on a printing result due to uneven supply of washing liquid is considered, a slit nozzle is desirable because a slit nozzle can supply washing liquid in the shape of uniform film along width direction of a printing cylinder.

In addition, a two fluid nozzle jetting washing liquid with pressurized gas is desirable because the nozzle can scrape out the ink residual substance which is collected in a concave portion of a relief printing plate.

Nozzles are arranged in the width direction of a printing cylinder. Distance between a nozzle and a printing cylinder is same as other distance between other nozzle and a printing cylinder. Each nozzle is placed at a position where a washing liquid from a nozzle is flowed on a printing cylinder.

A position of a nozzle of washing liquid supplying unit is explained below next. A nozzle is slanted against rotation direction of a printing cylinder. A nozzle should be installed so that washing liquid from a nozzle is supplied to a surface between a bottom point of a printing cylinder to a top point of a printing cylinder (side after printing).

In addition, an air blasting unit is explained below. An air knife nozzle is installed in parallel with a nozzle of a washing liquid supplying unit. Pressurized gas comprising air or inert gas is jetted on a relief printing plate surface from an air knife nozzle. Washing liquid left on a relief printing plate surface is blown down.

In addition, it is desirable that an air knife is also slanted to face rotation direction of a printing cylinder.

In addition, a common slit nozzle may be used as a nozzle of a washing liquid supplying unit and an air knife nozzle of an air blasting unit. From this single slit nozzle, washing liquid and pressurized gas can be jetted selectively. For this case, when pressurized gas is jetted, drop of washing liquid left at a slit nozzle tip is blown off. Therefore, the occurrence of defectiveness due to washing unevenness caused by liquid dripping of washing liquid from a slit nozzle tip to a relief printing plate surface can be prevented.

A washing liquid recovery unit is explained below. A washing liquid recovery unit receives washing liquid dripping from a nozzle of a washing liquid supplying unit. A washing liquid recovery unit receives the washing liquid which drips after its transmitting to a relief printing plate surface and a printing cylinder surface.

It is necessary for a washing liquid recovery unit to cover areas from an area just below a nozzle of a washing liquid supplying unit to an area just below a bottom of a printing cylinder. In addition, a washing liquid recovery unit of the following structure is better: Cleaning liquid receiving pan is connected directly with suction hole of suction unit; and a splash of washing liquid gathering on a catch pan is recovered by a suction unit.

A nozzle of a washing liquid supplying unit, a nozzle of an air blasting unit, a suction hole of a suction unit and a washing liquid recovery unit are accommodated in a cover. Only a part of this cover which a periphery of a printing cylinder faces opens. This cover has a curved surface-shaped opening along a shape of printing cylinder. Further a gap between a periphery of a printing cylinder and a cover is set to be less than 5 mm. A cover having the above mentioned gap prevents a splash of washing liquid used at the time of actuating a relief printing plate washing equipment from scattering in outside of a cover.

A wiper for a plate is explained below. A wiping roll is pushed to a surface of a relief printing plate installed in a printing cylinder in operation mode. While this wiping roll rotates, a printing cylinder rotates. Then wiping roll wipes off washing liquid bonded to a surface of a relief printing plate. In addition, a wiping roll may be an adhesive or absorbing roll. For this case, a wiping roll adsorbs washing liquid directly. For this case, cleaning of a wiping roll is also necessary. Therefore, a wiper for a plate having the following mechanisms is desirable: Film-shaped wiping sheet surrounding a surface of a wiping roll can be sandwiched between a wiping roll and a relief printing plate. For this case, wiping sheet is pushed to a surface of a relief printing plate. In this way washing liquid on a surface of a relief printing plate transfers to a surface of wiping sheet. Wiping sheet is roll sheet sent out from a supply roll. It is always necessary for a new surface of wiping sheet to face a relief printing plate. Therefore wiping sheet is sent in accordance with a rotation of a printing cylinder and a wiping roll, and recovery roll winds wiping sheet off. For materials of wiping sheet, a nonwoven fabric and a pressure sensitive adhesive sheet can be used. When influence due to generated dust or remains of adhesive is considered, resin films such as PET are desirable.

An operation of a relief printing plate washing equipment is described below. An embodiment that a luminescent layer of an organic electroluminescent element is formed by flexographic printing is explained.

Macromolecular organic luminous ink includes a volatile organic solvent. Ink residual substance accumulates on a surface of a relief printing plate due to drying of ink. By influence due to ink residual substance accumulating in a concave portion of a relief printing plate at the time point when printing of a certain amount of count is repeated, the following phenomenon occurs. A width of a printed line is enlarged more than a desired width. Because film thickness of a printed pattern fluctuates uncertainly, print unevenness occurs. Thus after having stopped printing operation temporarily, a relief printing plate washing equipment is operated again.

For this case, at first a printing cylinder is faced to a relief printing plate washing equipment so that a relief printing plate washing equipment can wash a relief printing plate. A printing cylinder is rotated next. When a front edge of a pattern part of a relief printing plate arrives at the vicinity of a nozzle of a washing liquid supplying unit, washing liquid begins to flow in a surface of a relief printing plate. Subsequently washing liquid in a surface of a relief printing plate is blown off by jetting pressure air to a surface of a relief printing plate from a nozzle of air blasting unit. A surface of a relief printing plate dries in this way.

Suction unit sucks a splash of washing liquid by operating a suction unit from the time printing cylinder is faced to a relief printing plate washing equipment. Quantity of suction of a suction unit is set to be bigger than quantity of discharge of air from an air blasting unit. Internal pressure of a cover of a relief printing plate washing equipment is lower than external-pressure. A splash of washing liquid and an atmosphere do not leak out from a gap between a cover and a printing cylinder. After washing a plate, a printing cylinder abuts on an ink supply device. And ink is supplied on a relief printing plate. However, a relief printing plate on which washing liquid component remains is hard to get used to ink. Therefore, ink is hard to be supplied on a relief printing plate sufficiently.

Thus a wiping roll of a wiper for a plate is pushed to a printing cylinder. At this time, ink undersupplied on a relief printing plate is wiped off once. Afterwards supply of ink and wipe of ink are repeated as many as the desired number of times. Then washing liquid components remaining on a relief printing plate decrease. Therefore, wettability of ink improves. And sufficient ink can be supplied.

After the above-mentioned process, a washing operation ends. Afterwards, printing operation stopping temporarily is started again.

Embodiment 2

A letterpress printing machine of the present invention has a mechanism to keep a fixed printing pressure within a printing face. A mechanism to keep a fixed printing pressure within a printing face is explained below. The mechanism senses change of printing pressure between a relief printing plate placed on a printing cylinder and a substrate put on a substrate surface plate. And the mechanism moves a substrate surface plate and/or a printing cylinder up and down. Then the mechanism can keep a fixed printing pressure within a printing face.

For such a mechanism, a pneumatic actuator, an air cylinder, a hydraulic actuator or a hydraulic cylinder can be used. A pneumatic actuator can be handled easily. A hydraulic actuator is powerful and is superior in repeatability. Depending on the weight and the size of a printing cylinder or a substrate surface plate supported by an actuator, a kind of an actuator can be selected.

In example 2, a letterpress printing machine which supports a shaft of a printing cylinder at two points and which an air cylinder is used as a printing pressure keeping mechanism is explained.

Embodiment 3

Figure 9:
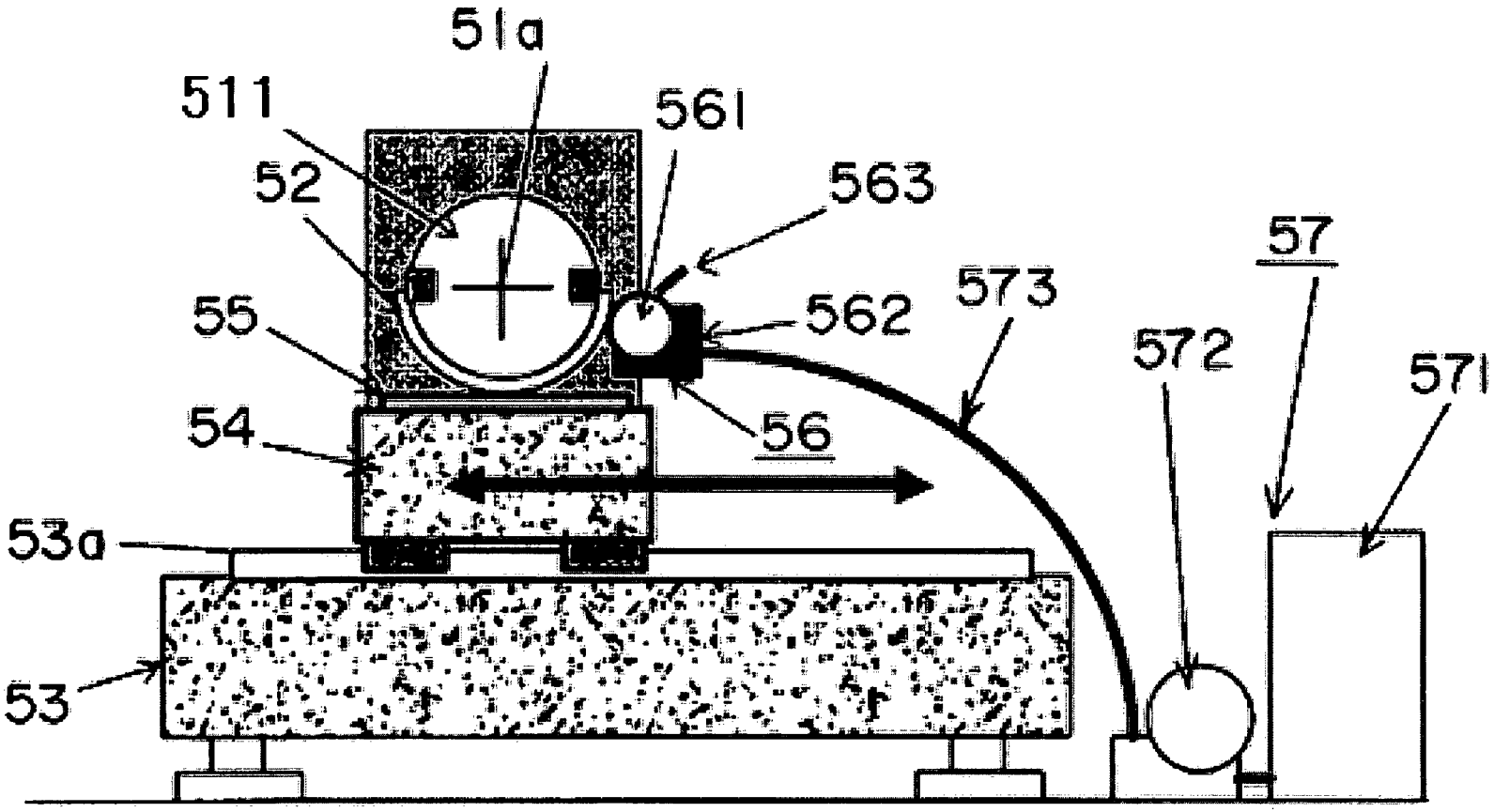
FIG. 9 is a letterpress printing machine (a flexographic printer) for luminescent layer formation of an organic electroluminescent display device in operation mode.

FIG. 9 is a schematic diagram of an apparatus which a letterpress printing machine of the present invention is applied to a flexographic printer which is suitable for forming luminescent layer of an organic electroluminescent element.

Figure 10:
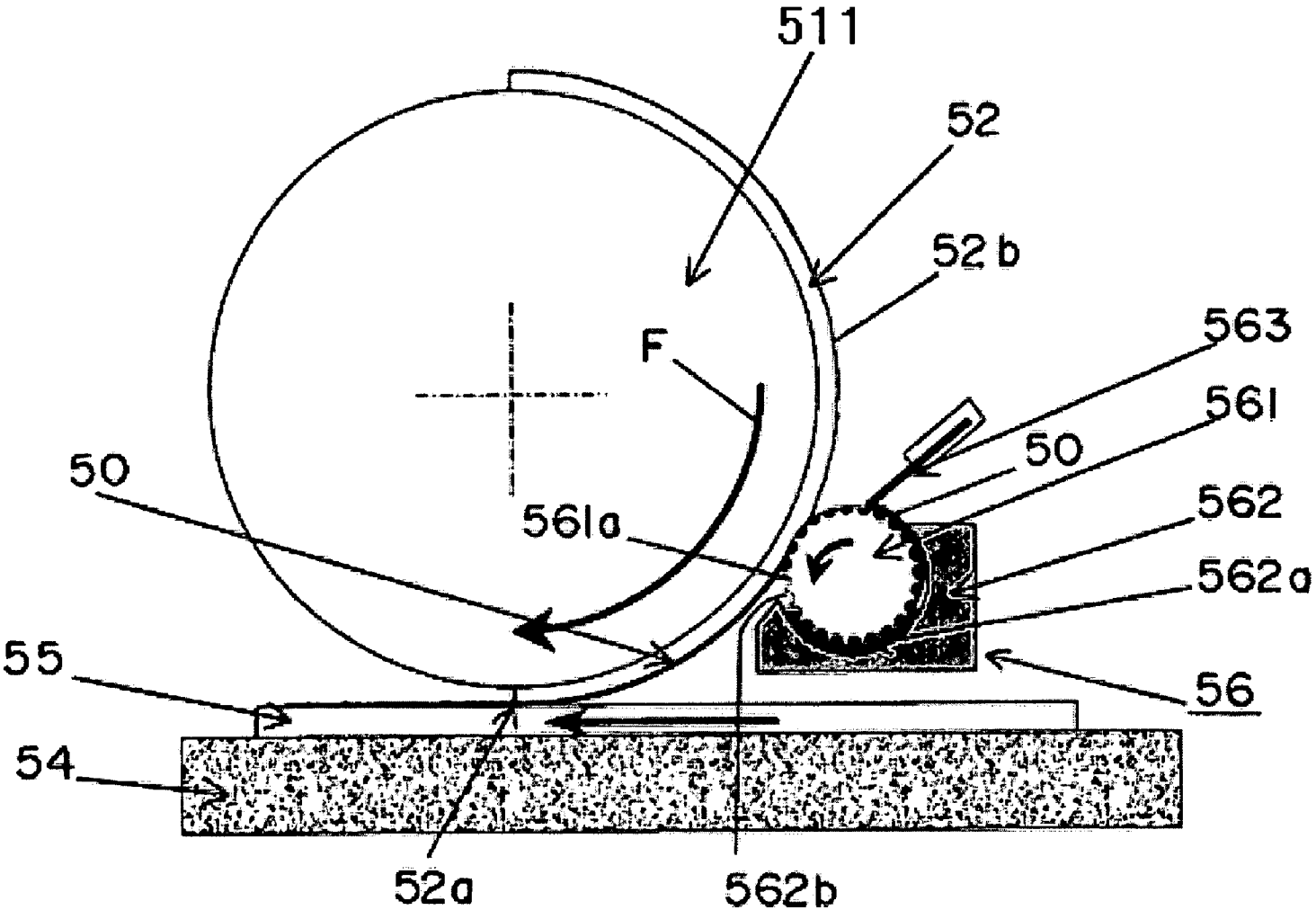
FIG. 10 is a letterpress printing machine (a flexographic printer) for luminescent layer formation of an organic electroluminescent display device in operation mode.

FIG. 10 is a schematic diagram showing movement of a printer of the present invention at the time of ink transposition.

A flexographic printer shown in this detailed description of the preferred embodiment has the following member as shown in FIG. 9 and FIG. 10: Rotary printing cylinder 511 supported at a fixed position; Relief printing plate (flexographic plate) 52 for luminescent pattern formation loaded on a surface of printing cylinder 511; Horizontal support base 53 under printing cylinder 511; Surface plate 54 which is placed on support base 53 through guide 53*a* and which is displaceable horizontally to a direction which is perpendicular to axis of rotation 51*a*; Substrate 55 put on surface plate 54; Ink supply means 56 supplying ink for a luminescent layer in a surface of relief printing plate 52; and Ink replenishing means 57 supplying ink regularly to ink supply means 56.

A position of ink supply means 56 is explained below. Ink supply means 56 exists between following two points.

1. Contact point 52*a* of relief printing plate 52 and substrate 55 (just under printing cylinder 511).
2. A position of right angle just before contact point in printing cylinder 511.

Ink supply means 56 has anilox roll 561, ink pot 562 and doctor 563. An anilox roll is explained below.

An anilox roll exists between following two points.

1. Contact point 52*a* of relief printing plate 52 and substrate 55.
2. A position of right angle just before contact point 52*a*.

An anilox roll 561 is placed in parallel with axis of rotation of printing cylinder 511. An anilox roll 561 touches relief printing plate 52. An anilox roll 561 supplies ink 50 for a luminescent layer to relief printing plate 52.

Ink pot 562 is explained below next. Ink pot 562 has ink storage 562*a* and opening 562*b*. Ink storage 562*a* maintains a lower surface part of an anilox roll 561 in dipping condition. A surface part of anilox roll 561 which does not soak in ink liquid protrudes from opening 562*b* to direction of relief printing plate 52. Doctor 563 scrapes off unnecessary ink stuck to a surface of anilox roll 561. It is desirable that a position where relief printing plate 52 abuts on anilox roll 561 is near contact point 52*a*. But ink supply means 56 must not touch surface plate 54 and substrate 55. In other words the time when ink is on relief printing plate 52 is short if distance from ink supply device to contact point 52*a* is short. Therefore, it is advantageous.

Anilox roll 561 rotates at the same peripheral-speed as peripheral-speed of printing cylinder 511. In a surface of anilox roll 561, there is small relief (concave portion) 561*a* to keep ink as shown in FIG. 10. When peripheral-speed of printing cylinder 511 is not same as peripheral-speed of anilox roll 561, relief 561*a* damages relief printing plate 52. Doctor 563 scrapes off unnecessary ink 50 stuck to a surface of anilox roll 561 coming out of ink storage 562*a*. Doctor 563 leaves ink only in relief 561*a* of anilox roll 561. As shape of doctor 563, blade and roll are exemplified.

Doctor 563 exists between following two points.

1. A position of ink storage 562*a*.
2. A point where anilox roll 561 abuts on relief printing plate 52.

In addition, it is desirable that doctor 563 is near ink storage 562*a*. For this case, ink scraped off drops in ink storage 562*a*.

Opening 562*b* of ink pot 562 should be blocked by anilox roll 561 to control volatilization of a solvent of ink in ink storage 562*a*. When a rim of opening 562*b* of ink pot 562 touches a surface of anilox roll 561, friction occurs in a rotation of anilox roll 561. Therefore, dust may be generated. Therefore, it is desirable that a gap between border of opening 562*b* and a surface of anilox roll 561 is less than or equal to 2 mm.

It is further desirable for inside shape of ink storage 562*a* to be concentric with anilox roll 561 for the following reasons. In addition, it is desirable that both member to be cylindrical. In addition, it is desirable for a gap between inside shape of ink storage 562*a* and anilox roll 561 to be 0.5 mm-5 mm.

1. It is necessary for a contact surface of ink storage 562*a* and the open air in ink pot 562 to be lower.
2. It is necessary to improve using efficiency of ink.

Ink replenishing means 57 comprises ink tank 571 and ink supplement pump 572. Ink tank 571 and ink pot 562 are connected by ink supplement pipe 573 using ink supplement pump 572. Ink is supplied from ink tank 573 to ink pot 562 by driving regularly ink supplement pump 572 according to number of printing times. In this way quantity and viscosity of ink in ink storage 562*a* are maintained uniformly.

A mechanism to suck out ink in ink storage 562*a* from an ink pot may be provided. By this mechanism, ink in ink storage 562*a* can be exchanged.

Next, movement of ink transposition in flexograpliic printer for organic electroluminescent is described below using FIG. 9 and FIG. 10. On the occasion of ink transposition to substrate 55, substrate 55 is fixed to surface plate 54 as shown in FIG. 9. Surface plate 54 is moved to a bottom of printing cylinder 511. Simultaneously, printing cylinder 511 is rotated at peripheral-speed in correspondence with travelling speed of surface plate 54. In this case, relief printing plate 52 installed in printing cylinder 511 abuts on anilox roll 561. Ink in relief 561*a* of anilox roll 561 is applied to relief printing plate 52. Afterwards ink applied to relief printing plate 52 transfers to substrate 55 at the time when the ink rotate to a bottom of printing cylinder 511. In this way transposition of ink 50 from ink supply means 56 to relief printing plate 52 and transposition of ink 50 from relief printing plate 52 to substrate 55 can be performed at the same time.

In printing with the use of a flexographic printer, the surface of anilox roll 561, which is exposed from ink storage 562*a*, is easy to dry. When ink in relief 561*a* hardens, the nonuniformity of the ink amount of supply arises. Therefore, the surface of anilox roll 561 should be wetted by soaking the surface of anilox roll 561 in ink storage 562*a* periodically. Therefore, in stand-by time besides ink transposition time, it is desirable to continue rotating anilox roll 561.

At time except ink transposition time, ink should not be applied to relief printing plate 52. Therefore, the mechanism which anilox roll 561 or the whole of ink supply means 56 evacuates from printing cylinder 511 should be provided.

Or a surface of printing cylinder 511 where relief printing plate 52 is not put may not abut on anilox roll 561. For this case, in stand-by time, this surface faces anilox roll 561.

Or printing cylinder 511 may go up and down. For this case, in stand-by time except ink transposition time, relief printing plate 52 leaves anilox roll 561 because printing cylinder 511 rises. Because printing cylinder 511 drops, relief printing plate 52 abuts on anilox roll 561 at ink transposition time.

In the above mentioned embodiment, surface plate 54 moves under printing cylinder 511 in the horizontal direction. However, the present invention is not limited to the above mentioned embodiment. Surface plate 54 may be fixed, and printing cylinder 511 and ink supply means 56 may move in the horizontal direction.

(Effect: 1)

According to the letterpress printing machine of the present invention, a relief printing plate can be washed without damaging a relief printing plate while a relief printing plate is installed in a printing cylinder.

Therefore, good printing can be performed right after washing a relief printing plate because wettability of ink to a relief printing plate improves.

(Effect: 2)

According to the current invention, printing can be performed at constant printing pressure within a printing face. Therefore, when there is undulation in a surface of press plate and a surface of substrate, quality trouble due to printing pressure variation in a printing direction and a direction which is perpendicular to a printing direction can be reduced.

In addition, even if thickness of a printing plate (a relief printing plate), a cushion under a plate or the like is uneven, a stable high quality printing is possible.

(Effect: 3)

According to the current invention, transposition of ink from ink supply means to a relief printing plate and transposition of ink from a relief printing plate to a substrate can be performed almost simultaneously.

In addition, distance from an ink supply position to a relief printing plate to a printing position to a substrate can be shortened. Time from ink transposition to a relief printing plate to ink transposition to a substrate can be shortened.

Therefore, as for the organic electroluminescent element that a macromolecular organic luminescent layer is formed using a printer of the present invention, luminous efficiency is high. In addition, an inexpensive macromolecular organic electroluminescent element of long characteristic life can be manufactured.

EXAMPLE 1

Figure 2:
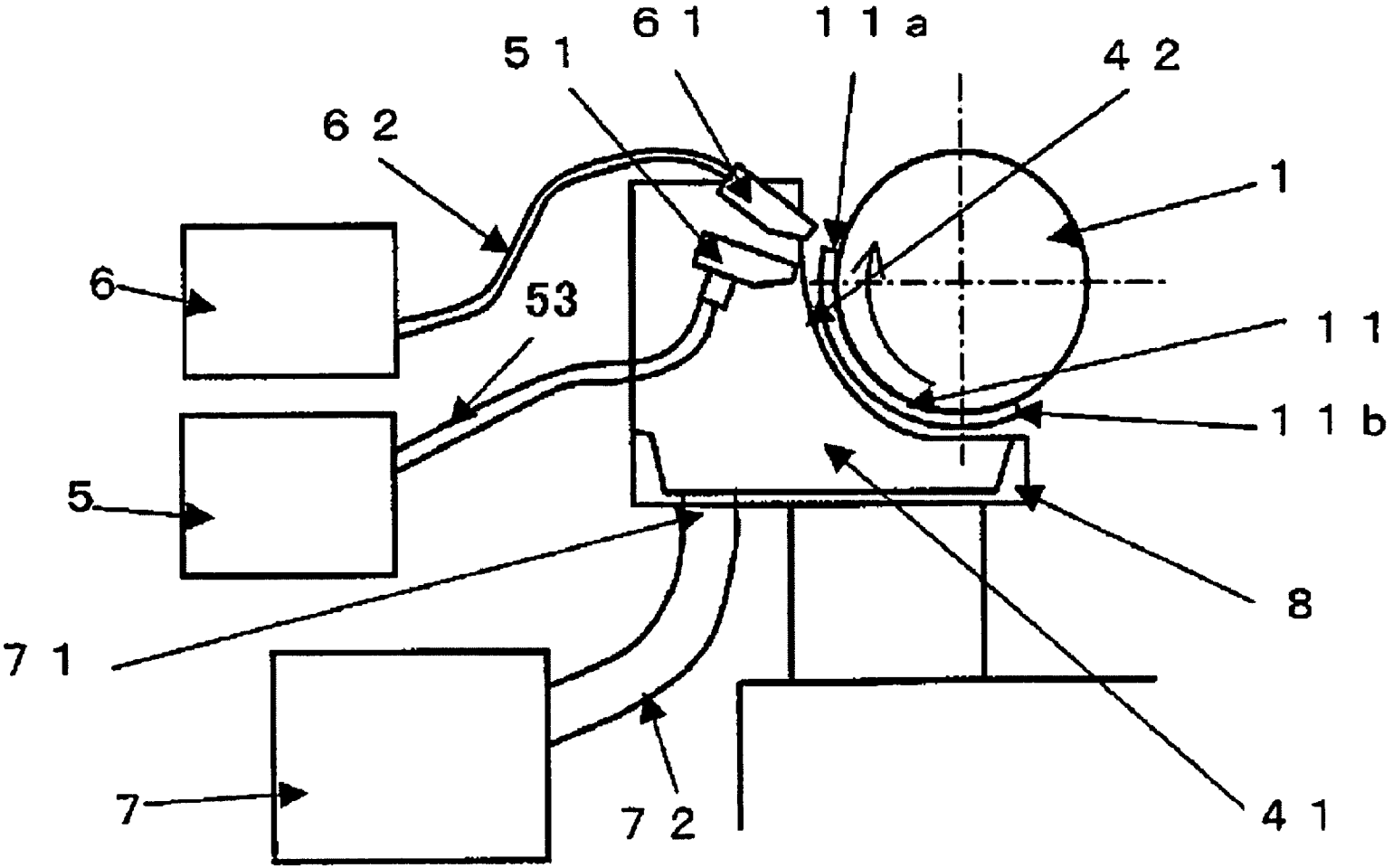
FIG. 2 is a schematic diagram of a plate washing device included in a letterpress printing machine of example 1 in operation mode.
Figure 3:
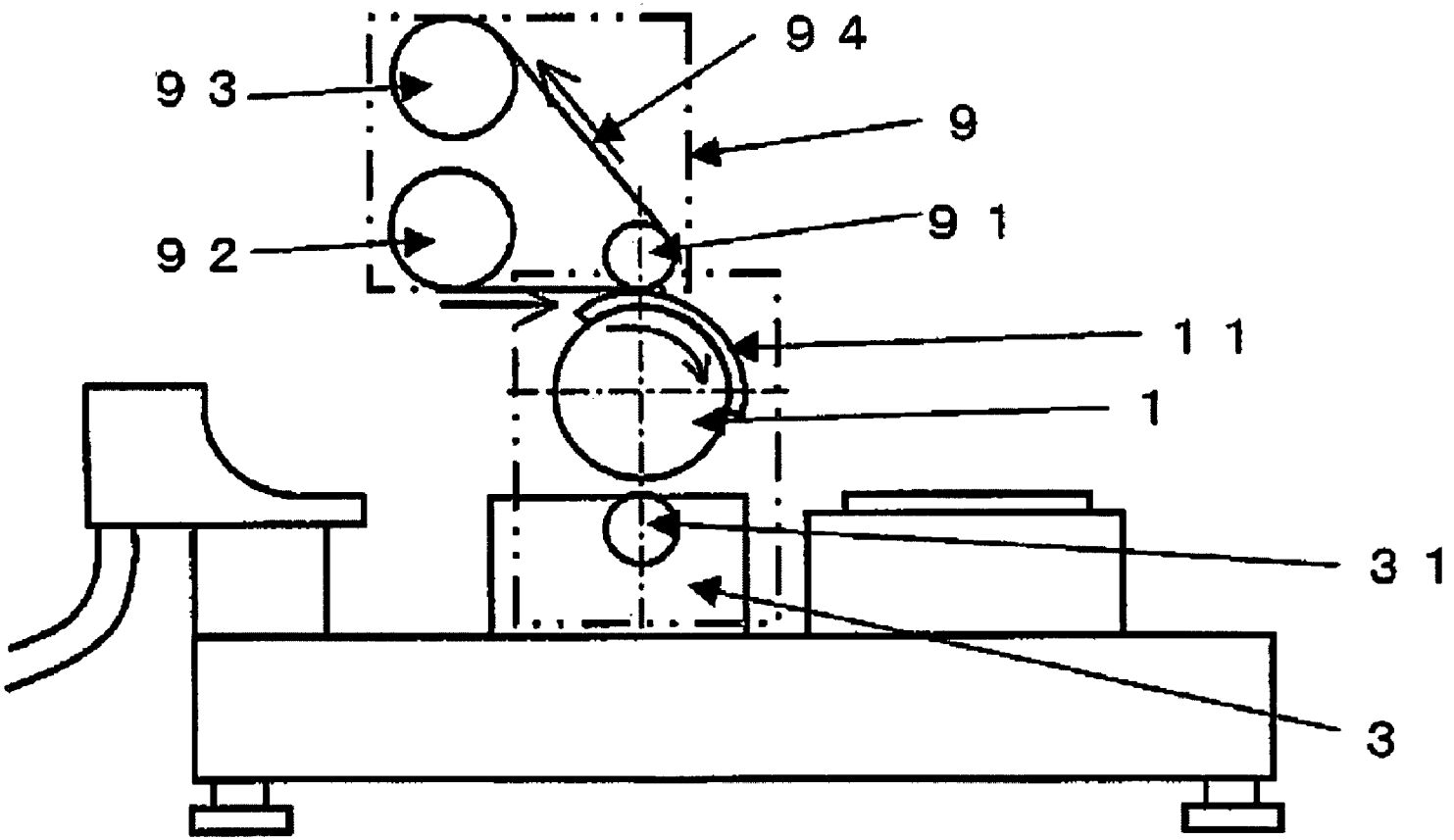
FIG. 3 is a schematic diagram of a wiper for a plate in a letterpress printing machine of example 1 in operation mode.
Figure 4:
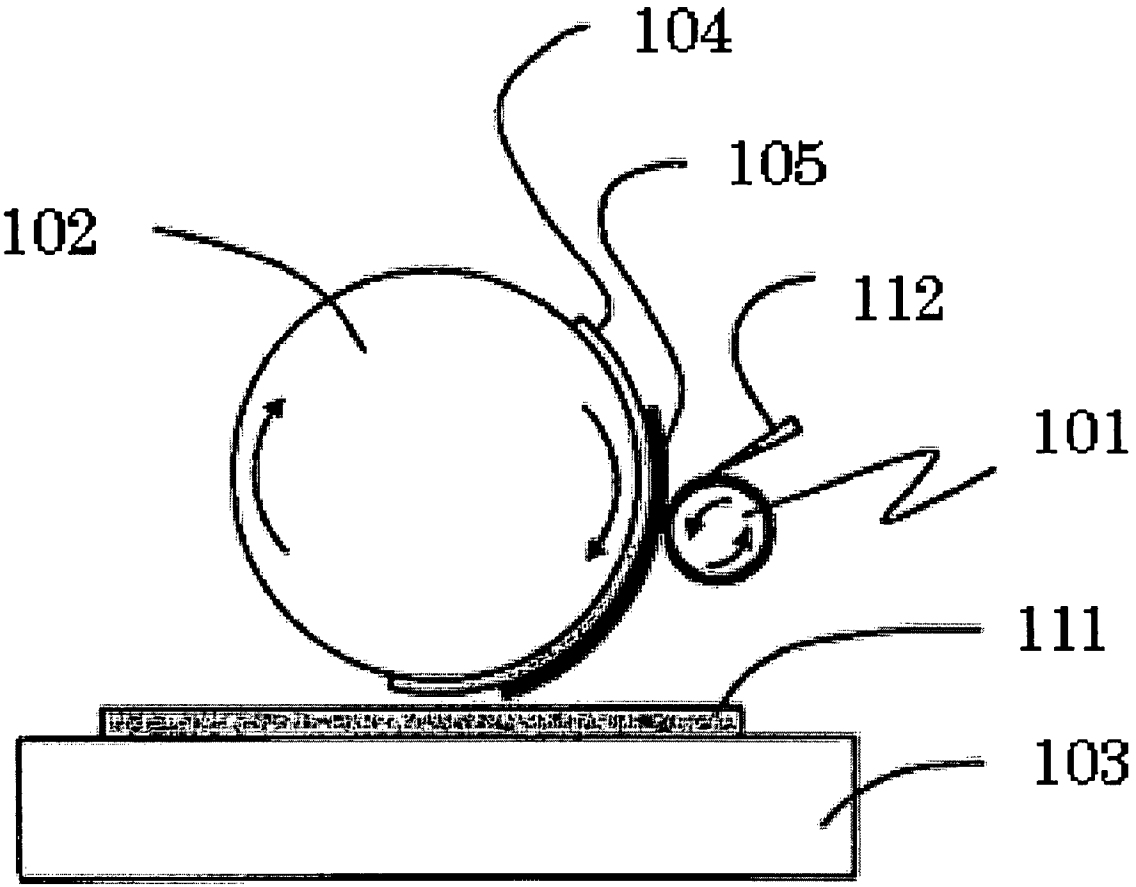
FIG. 4 is a schematic diagram of a printing cylinder, a dispenser mechanism and a substrate surface plate used in flexographic printing.

The first embodiment of letterpress printing machine of the present invention is explained below using drawing. FIG. 1 is general drawing of a letterpress printing machine. FIG. 2 is a schematic diagram of a relief printing plate washing equipment included in a letterpress printing machine at the operation time. FIG. 3 is a schematic diagram of a wiper for a plate included in a letterpress printing machine at the operation time.

Letterpress printing machine has the following member as shown in FIG. 1: Mobile printing cylinder 1; Substrate surface plate 2 on base of a printer 10; Ink supply device 3; Relief printing plate washing equipment 4; and Wiper for plate 9 having a unillustrated lift mechanism, wherein Wiper for plate 9 is in the position that is higher than a passage path of printing cylinder 1 and wherein Wiper for plate 9 is above ink supply device 3. This letterpress printing machine is a flexographic printer, and it is used in a pattern printing of a luminescent layer of an organic electroluminescent element.

Relief printing plate washing equipment 4 washes the surface of relief printing plate 11 installed in printing cylinder 1.

Relief printing plate washing equipment 4 has the following member as shown in FIG. 2: Washing liquid supplying unit 5 supplying washing liquid in the surface of relief printing plate 11 installed in printing cylinder 1; Air blasting unit 6 jetting pressurized gas in the surface of relief printing plate 11 after washing liquid is supplied to relief printing plate 11; Suction unit 7 sucking washing liquid scattered by injection of pressurized gas from air blasting unit 6; Catch pan 8 for washing liquid recovery which receives washing liquid flowing down after it is supplied in the surface of relief printing plate 11.

Washing liquid supplying unit 5 has washing liquid spray nozzle 51 jetting washing liquid in the surface of relief printing plate 11 as shown in FIG. 2. This washing liquid spray nozzle 51 is connected to washing liquid supplying unit 5 by washing liquid supply hose 53.

In addition, air blasting unit 6 has gas injection nozzle 61 jetting pressurized gas in the surface of relief printing plate 11 on which washing liquid is supplied as shown in FIG. 2. This gas injection nozzle 61 is connected to air blasting unit 6 by pressurized gas supply hose 62.

In addition, suction unit 7 has suction hole 71 connecting with a bottom of cleaning liquid receiving pan 8 as shown in FIG. 2. This suction hole 71 is connected to suction unit 7 by suction hose 72.

Relief printing plate washing equipment 4 has cover 41 accommodating washing liquid spray nozzle 51, gas injection nozzle 61 and cleaning liquid receiving pan 8 as shown in FIG. 2. Shape of cover 41 of a part corresponding to an outer circumferential curved surface of printing cylinder 1 is shape of a curved surface corresponding to a periphery curved surface of printing cylinder 1. And part 42 of a curved surface of cover 41 opens. Further a gap between outer circumferential curved surface of printing cylinder 1 and curved surface 42 is set to be less than 5 mm. In addition, washing liquid supply nozzle 51 and gas injection nozzle 61 faces an opening of curved surface 42 as shown in FIG. 2. Washing liquid supply nozzle 51 and gas injection nozzle 61 are arranged just before and after direction of rotation of printing cylinder 1.

Wiper for plate 9 has the following member as shown in FIG. 1 and FIG. 3: Wiping sheet supply roll 92 winding washing liquid wiping sheet 94 which is a long film into a roll; Wiping roll 91 which forces wiping sheet 94 sent out from supply roll 92 on relief printing plate 11 installed in printing cylinder 1; Recovery roll 93 winding off wiping sheet 94 after wiping off washing liquid stuck to the surface of relief printing plate 11.

Ink supply device 3 supplies ink including a macromolecular luminous body through anilox roll 31 to relief printing plate 11 installed in printing cylinder 1. Afterwards while printing cylinder 1 rolls over substrate 21 placed on substrate surface plate 2, relief printing plate 11 is pushed to the surface of substrate 21. In this way a luminescent layer is formed by transferring pattern-formed ink.

This printing operation is repeated about 20-100 times. Then ink residual substance left in the surface of relief printing plate 11 accumulates. Therefore, a concave portion of relief printing plate 11 is filled up with ink. Then a width of a printed line becomes bigger than a desired line. Or print unevenness occurs.

Thus, as shown in FIG. 2, printing cylinder 1 is moved to the position where printing cylinder 1 abuts on relief printing plate washing equipment 4. Printing cylinder 1 is rotated.

The following operation is performed since front edge 11*a* of relief printing plate 11 arrives at the vicinities of nozzle 51 of washing liquid supplying unit 5: A toluene as washing liquid is sprayed on the surface of relief printing plate 11 from nozzle 51 of washing liquid supplying unit 5; A pressurized air is sprayed on relief printing plate 11 from nozzle 61 of air blasting unit 6 at the same time; and A splash of a toluene and a toluene dripping on cleaning liquid receiving pan 8 are sucked from suction hole 71 of suction unit 7 at the same time.

These operations are performed up to rear end 11*b* of relief printing plate 11. A washing operation is finished afterwards.

Subsequently, as shown in FIG. 3, printing cylinder 1 is moved to the position where printing cylinder 1 abuts on ink supply device 3. And while rotating printing cylinder 1, ink is supplied to relief printing plate 11. Printing cylinder 1 is raised afterwards. And relief printing plate 11 abuts on wiping roll 91 of wipe unit 9 through wiping sheet 94. And printing cylinder 1 and wiping roll 91 are rotated at the same peripheral-speed. While sending wiping sheet 94, ink stuck in the surface of relief printing plate 11 transfers to wiping sheet 94. Ink is wiped off in this way.

Afterwards supply of ink and wipe of ink are repeated about 1-5 times alternately in the same way. Then printer is returned to normal operation.

Luminescent layer printing of an organic electroluminescent element is performed. Then a luminescent layer having line of a desired width is formed.

According to this letterpress printing machine, conventional waste printing to substrate is unnecessary. Therefore, consumption of useless substrate can be prevented. And this letterpress printing machine is applied to a pattern printing of a luminescent layer of an organic electroluminescent element. Then the inexpensive macromolecular organic electroluminescent elements which can display an image of a high quality can be manufactured.

EXAMPLE 2

The second embodiment is explained below.

Figure 5:
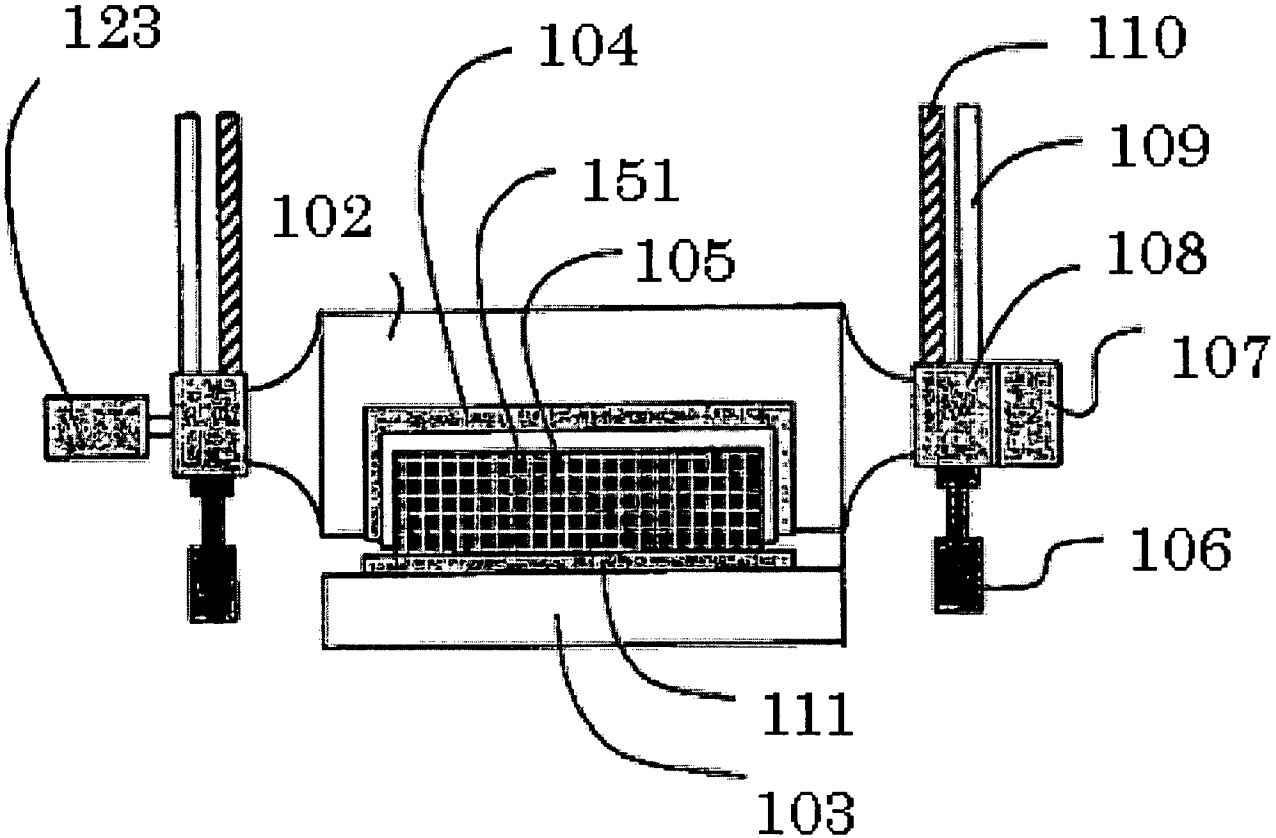
FIG. 5 is a block diagram of a letterpress printing machine in example 2.

FIG. 5 is the schematic diagram which shows mechanism keeping printing pressure at the time of printing by supporting a printing cylinder of a letterpress printing machine from its lower side.

Figure 6:
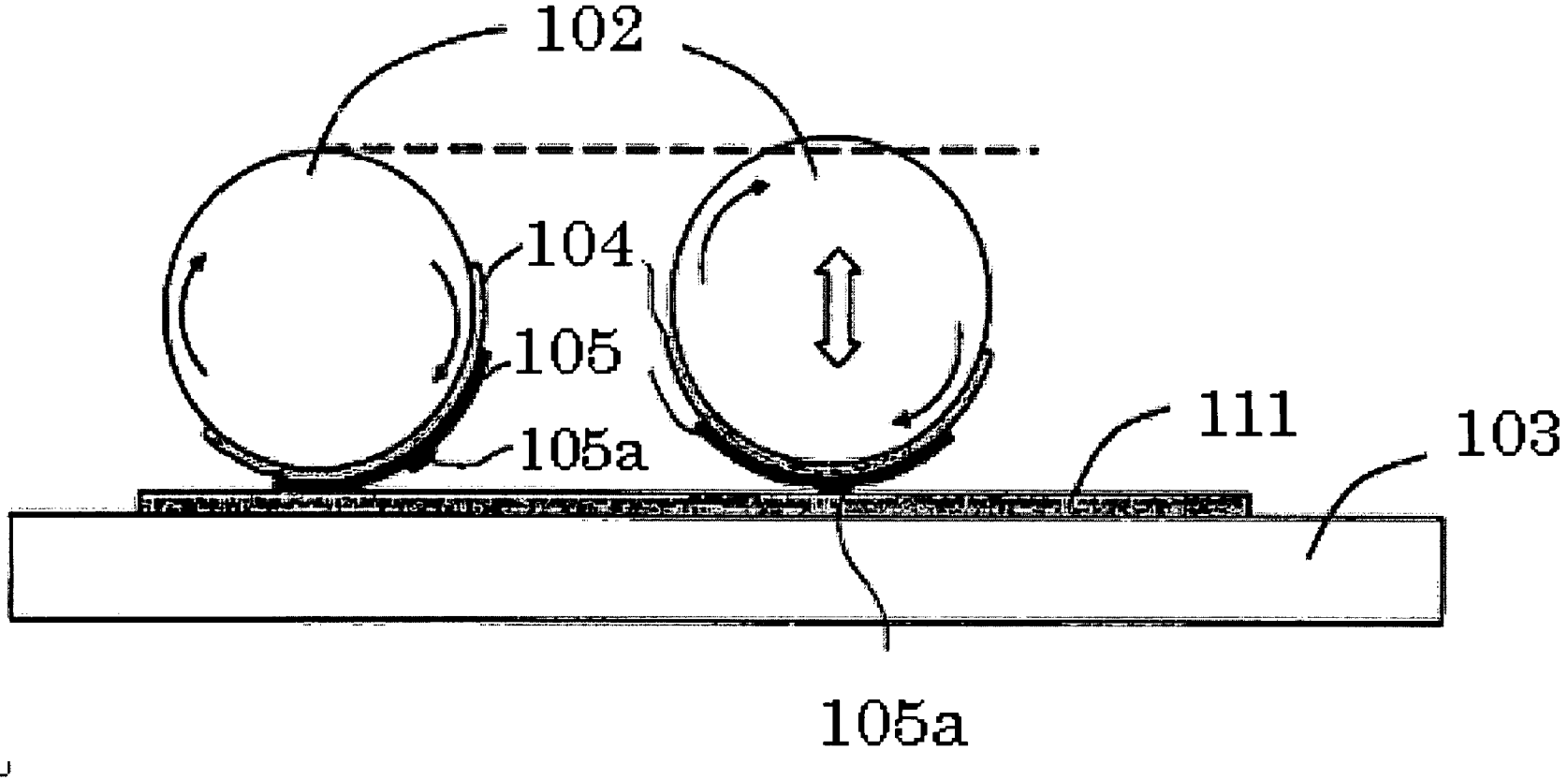
FIG. 6 is an illustration of a letterpress printing machine of example 2 in operation mode.

FIG. 6 is the explanatory drawing which shows the situation wherein printing cylinder follows undulation in the surface of relief printing plate up and down at printing.

Figure 7:
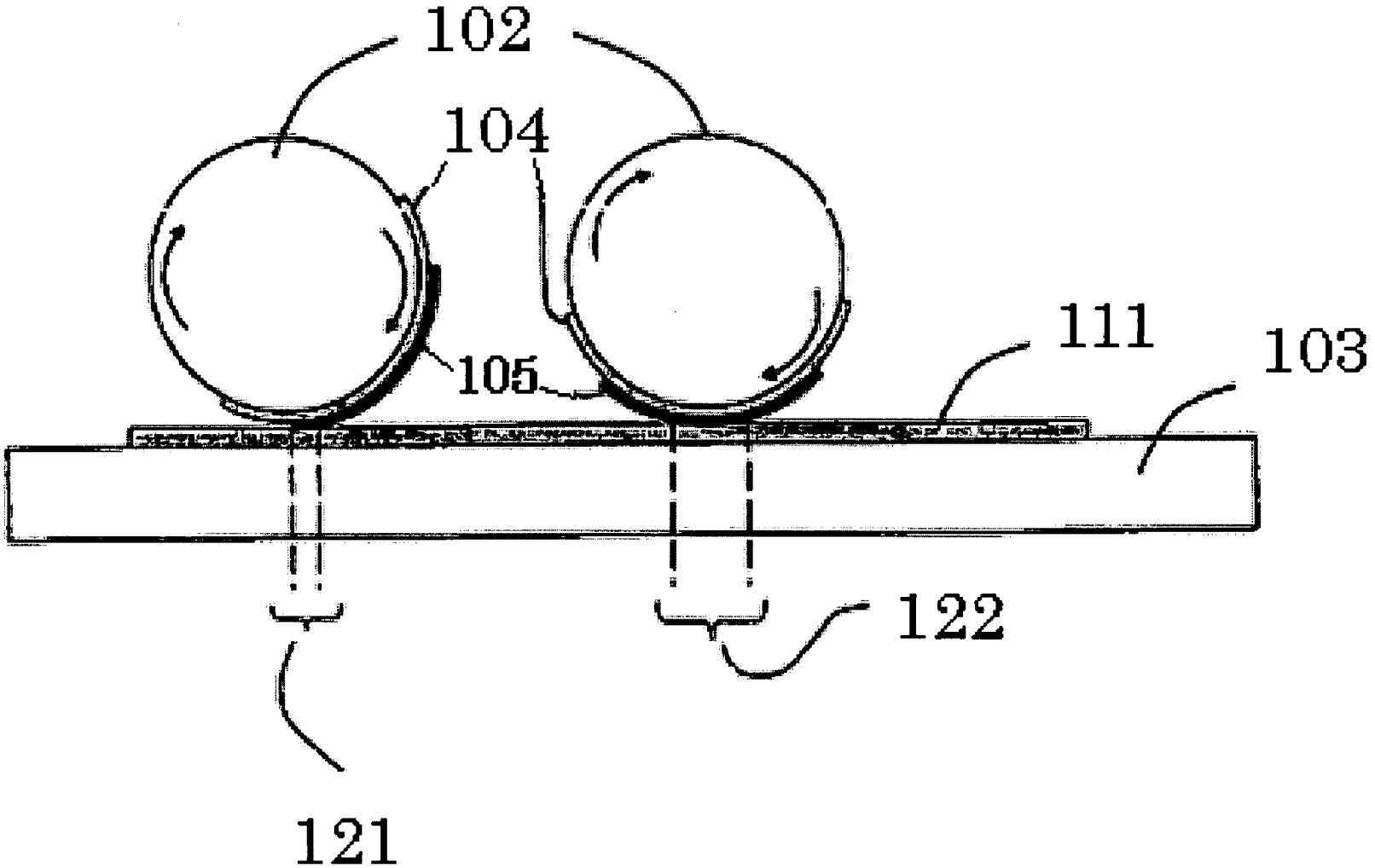
FIG. 7 is an illustration of printing nip width of letterpress printing machine in example 2.

FIG. 7 is an illustration of a difference between printing nip width at the time of a printing beginning and printing nip width in the middle of printing.

Figure 8:
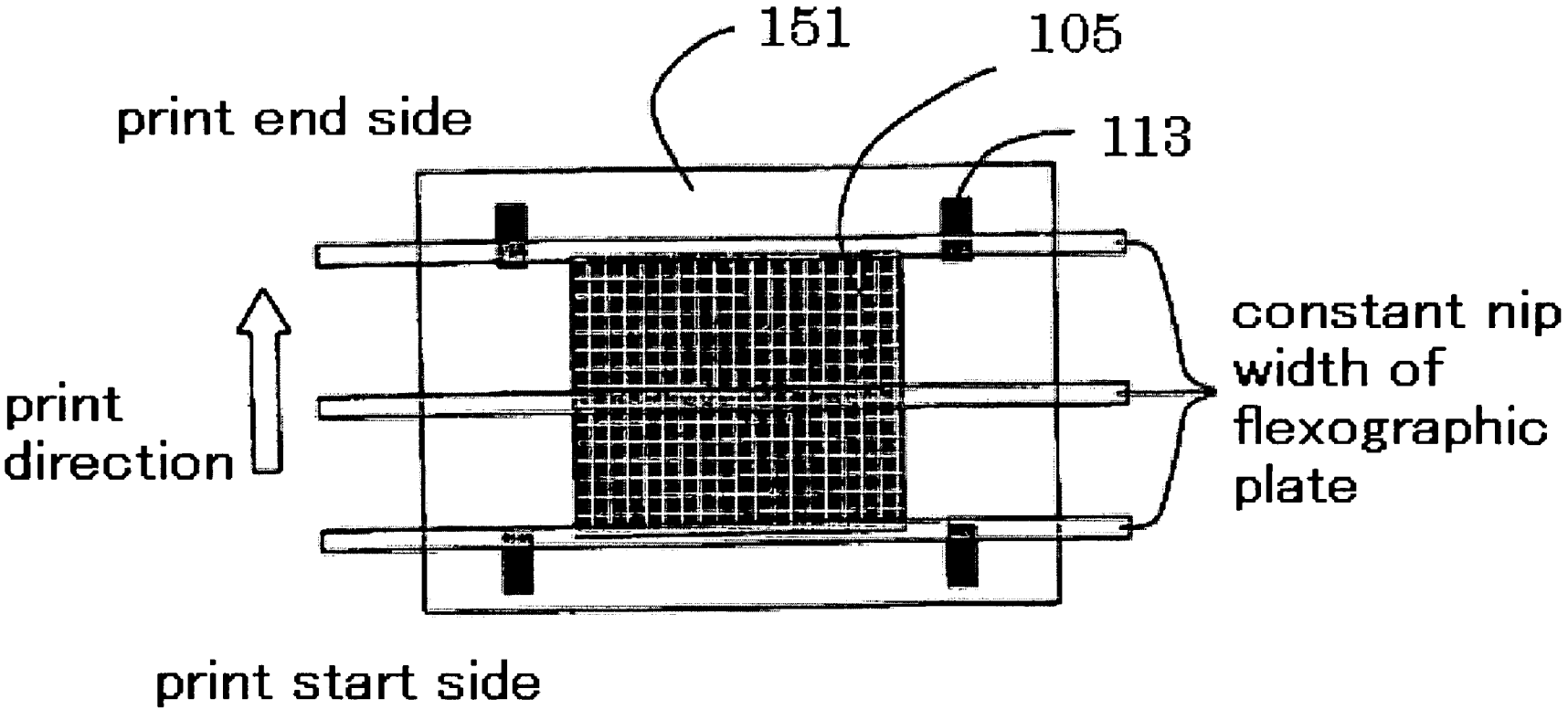
FIG. 8 shows the belt-shaped pattern which is installed in substrate so that printing pressure is constant.

FIG. 8 is explanatory drawing of the band-shaped pattern which is installed in pattern board wherein the band-shaped pattern keeps printing pressure constant from printing beginning time to printing ending time.

Letterpress printing machine has the following member as shown in FIG. 5: Substrate surface plate 103 holding substrate 111; Printing cylinder 102 which flexographic plate 105 is attached to; A pair of printing cylinder bearing 108 supporting a both ends of a shaft of this printing cylinder 102 rotatably; A pair of air cylinders 106 holding each printing cylinder bearing 108 with a constant pressure from their lower sides; and A pair of vertical axis for printing cylinder (linear guides) 109 guiding each printing cylinder bearing 108 in above or below direction independently.

In addition, printing cylinder 102 has a pair of up/down driving shaft (ball screw) 110 moving printing cylinder 102 in above or below direction to a position of a printing situation or a position of a printing stand-by state, independent of vertical axis 109 for printing cylinder.

Flexographic plate 105 is formed on pattern board 151. Flexographic plate 105 including pattern board 151 is loaded on an outer circumferential surface of printing cylinder 102 through cushion 104 under a plate. In addition, balancer 107 keeping a rotational balance of printing cylinder 102 is installed in one end of a shank of printing cylinder 102. Printing cylinder drive motor 123 driving rotationally printing cylinder 102 is installted in another end of a shank of printing cylinder 102.

When printing cylinder 102 drops to a printing situation position by up/down driving shaft 110, printing cylinder bearing 108 is supported by air cylinder 106 of a constant air pressure from its lower side. Therefore, printing pressure is kept uniformly when flexographic plate 105 contacted with substrate 111. In addition, depending on the undulation in the surface of flexographic plate 105 and the undulation of substrate 111 at the time of printing, printing cylinder 102 is supported by air cylinder 106 from its lower side against self-weight pressure of printing cylinder 102.

Air cylinder 106 works so that printing pressure between flexographic plate 105 and substrate 111 within a printing face becomes constant.

Like printing cylinder 102 on the left hand side of FIG. 6, undulation 105*a* in the surface of flexographic plate 105 does not contact with substrate 111. Like printing cylinder 102 shown in the right side of FIG. 6, undulation 105*a* in the surface of flexographic plate 105 contacts with substrate 111. Printing cylinder 102 rises over a height as shown in a broken line of FIG. 6, printing pressure between flexographic plate 105 and substrate 111 within a printing face rises. Then change of printing pressure within a printing face is sensed. Subsequently the fluid pressure control circuit of air cylinder 106, which is not illustrated, works. Then, by an operation of air cylinder 106, printing pressure between flexographic plate 105 and substrate 111 within a printing face become constant.

When printing cylinder 102 is held from its lower side by air cylinder 106 with a constant pressure, a contact area of flexographic plate 105 and substrate 111 at printing beginning time (printing ending time) is different from a contact area of flexographic plate 105 and substrate 111 at printing time as shown in FIG. 8. Therefore, printing pressure of unit area of flexographic plate 105 varies.

Thus, as shown in FIG. 8, band-shaped pattern 113 is preformed along printing direction in outside margin of a printed pattern. Thickness of this band-shaped pattern 113 is almost same thickness as a printed pattern. Band-shaped pattern 113 is formed for the purpose of load area of press plate at the time of printing becoming constant. Then printing pressure of unit area at the time of printing beginning time, at the time of printing ending time and in the middle of printing become constant. In other words printing pressure within a printing face becomes constant. Therefore, depending on the undulation in the surface of press plate when flexographic plate 105 and cushion 104 under a plate is exchanged, printing pressure of unit area of flexographic plate 105 is possible to be constant by operating a pair of air cylinders 106. And printing can be performed with constant printing pressure. Even if thickness of flexographic plate 105, a cushion under a plate or the like is uneven, stable high quality printing is enabled.

In addition, printing nip width 121 at the time of a printing beginning of flexographic plate 105 (the left side of FIG. 7) is different from nip width 122 in the middle of printing of flexographic plate 105 (the right side of FIG. 7). Therefore, in the case of printing with constant printing pressure, printing pressure of unit area varies. Thus the above mentioned problem can be solved by moving right side and left side of printing cylinder 102 up and down independently using a pair of air cylinders 106. Therefore, conventional troublesome nip adjustment becomes needless. In addition, print quality reduction due to printing pressure variation within a printing face can be prevented.

In addition, the present invention is not limited to letterpress printing machine shown in example 2. In addition, in example 2, the apparatus that both ends of printing cylinder 105 are supported at two points by air cylinder 106 is shown. However, printing cylinder 105 and/or substrate surface plate 103 may be supported by air cylinder 106 at several point more than two points.

EXAMPLE 3

The third embodiment is described below.

Time from applying ink to relief printing plate 52 to transferring ink to substrate 55 was about 1 sec when letterpress printing machine of the present invention was used. In addition, the ink completely transferred to substrate 55 when ink including methyl anisole (boiling point 177 degrees Celsius) was used as a solvent. Thus, substrate 55 on which ink transferred was dried using a vacuum dryer at 140 degrees Celsius.

And an organic electroluminescent element was made.

Then there was little deterioration in luminous efficiency of a luminescent layer. The luminous efficiency when an organic electroluminescent element of an active method was driven at drive voltage 5V was about 9.2 cd/A.

In addition, the ink was able to transfer on substrate 55 when ink including xylene (boiling point 110 degrees Celsius) as a solvent was used. Substrate 55 on which ink transferred dried at room temperature. Afterwards an organic electroluminescent element was made. The deterioration of luminous efficiency of a luminescent layer was not observed. The luminous efficiency when an organic electroluminescent element of an active method was driven at drive voltage 5V was about 10.0 cd/A.

What is claimed is:

1. A letterpress printing machine, comprising:

a rotary printing cylinder in which a relief printing plate is installed;

a substrate surface plate on which a substrate is placed;

an ink supply device supplying ink to the relief printing plate;

a relief printing plate washing equipment washing a surface of the relief printing plate; and a wiping device which wipes off a washing liquid on the relief printing plate after washing, wherein the relief printing plate washing equipment includes a washing liquid supplying unit supplying the washing liquid to the surface of the relief printing plate, an air blasting unit jetting a pressurized gas to the relief printing plate to which the washing liquid is supplied, a suction unit sucking the washing liquid scattered by the air blasting unit, and a washing liquid recovery unit receiving the washing liquid supplied to the surface of the relief printing plate by a pan below a bottom of the rotary printing cylinder.

2. The letterpress printing machine according to claim 1, wherein the washing liquid supplying unit supplies only the washing liquid to the surface of the relief printing plate without the washing liquid supplying unit touching the relief printing plate.

3. The letterpress printing machine according to claim 1, wherein the washing liquid is supplied to a region of the printing cylinder, the region being from a bottom point of the printing cylinder to a top point of the printing cylinder, and the region being in a side of the washing liquid supplying unit.

4. The letterpress printing machine according to claim 1, wherein the washing liquid supplying unit includes a washing liquid spray nozzle jetting the washing liquid to the surface of the relief printing plate, the air blasting unit includes a gas injection nozzle jetting the pressurized gas to the relief printing plate after the washing liquid is jetted, and the suction unit includes a suction hole sucking a splash of the washing liquid, wherein the washing liquid spray nozzle, the gas injection nozzle and the washing liquid recovery unit are accommodated in a cover, and wherein the cover has an open part corresponding to an outer circumferential curved surface of a printing cylinder, and a gap between the outer circumferential curved surface of the printing cylinder and the open part of the cover is less than 5 mm.

5. The letterpress printing machine according to claim 4, wherein the washing liquid spray nozzle and the gas injection nozzle face the open part of the cover, and the washing liquid spray nozzle and the gas injection nozzle are arranged just before and after direction of rotation of the printing cylinder.

6. The letterpress printing machine according to claim 4, wherein a common nozzle is used as the washing liquid spray nozzle and the gas injection nozzle, and the washing liquid and the pressurized gas can be jetted selectively from the common nozzle.

7. The letterpress printing machine according to claim 1, wherein the wiping device includes a wiping sheet feeder sending a wiping sheet which is long, a wiper wiping the washing liquid off with the wiping sheet touching the relief printing plate, and a collector collecting the wiping sheet after having wiped off the washing liquid.

* * * * *